US009637808B2

(12) United States Patent
Huettner et al.

(10) Patent No.: US 9,637,808 B2
(45) Date of Patent: May 2, 2017

(54) REFILL FOR A BALL-POINT PEN AND USE THEREOF

(71) Applicant: WIELAND-WERKE AG, Ulm (DE)

(72) Inventors: Susanne Huettner, Neu-Ulm (DE); Timo Allmendinger, Blaustein (DE); Rudolf Liebsch, Voehringen (DE)

(73) Assignee: Wieland-Werke AG, Ulm (DE)

( * ) Notice: Subject to any disclaimer, the term of this patent is extended or adjusted under 35 U.S.C. 154(b) by 0 days.

(21) Appl. No.: 14/777,218

(22) PCT Filed: May 15, 2014

(86) PCT No.: PCT/EP2014/001321
§ 371 (c)(1),
(2) Date: Sep. 15, 2015

(87) PCT Pub. No.: WO2014/187544
PCT Pub. Date: Nov. 27, 2014

(65) Prior Publication Data

US 2016/0040269 A1 Feb. 11, 2016

(30) Foreign Application Priority Data

May 24, 2013 (DE) ..... 10 2013 008 822

(51) Int. Cl.
*C22C 9/04* (2006.01)
*C22F 1/08* (2006.01)
*B43K 1/08* (2006.01)

(52) U.S. Cl.
CPC ..... *C22C 9/04* (2013.01); *B43K 1/082* (2013.01); *C22F 1/08* (2013.01)

(58) Field of Classification Search
CPC combination set(s) only.
See application file for complete search history.

(56) References Cited

U.S. PATENT DOCUMENTS 3,773,504 A 11/1973 Niimi et al.
4,061,430 A * 12/1977 Herrnring ..... C25D 5/18 401/216
5,114,468 A 5/1992 Akutsu et al.
9,080,226 B2 7/2015 Gillieron et al.
2006/0065336 A1 3/2006 Gillieron et al.
2008/0240973 A1 10/2008 Gaag et al.
2009/0022620 A1 1/2009 Weber

FOREIGN PATENT DOCUMENTS

CN 102851533 A 1/2013
DE 10 2007 029 991 A1 1/2009
DE 10 2009 021 336 A1 11/2010
EP 1 608 789 B1 12/2005
JP S63130738 A 6/1988
JP H02133537 A 5/1990
JP 2004183056 A 7/2004
WO WO 2004/083471 A2 9/2004
WO WO 2007/068368 A1 6/2007

OTHER PUBLICATIONS

English language translation of an article entitled "Pen Manufacturing Materials", by Zhou Yongqiang et al., China Light Industry Press, Mar. 2007, pp. 166-167 (11 pages).
International Search Report issued in Application No. PCT/EP2014/001321 with English translation date of mailing Oct. 6, 2014 (6 pages).
English-language Chinese Office Action of corresponding Chinese Application No. CN 2014800179005, dated Jul. 27, 2016 (6 pages).
Material for manufacturing pen, by Yongqiang Zhou et al, China Light Industry Press, Mar. 2007, pp. 166-167.

* cited by examiner

*Primary Examiner* — David Walczak
(74) *Attorney, Agent, or Firm* — Flynn, Thiel, Boutell & Tanis, P.C.

(57) ABSTRACT

A refill for a ball-point pen has an ink cartridge and a ball, the ball being arranged in a writing tip provided at the front end of the ink cartridge, wherein at least the writing tip of the ink cartridge is made solely of a copper-zinc alloy of the following composition (wt. %): 28.0 to 36.0% Zn, 0.5 to 1.5% Si, 1.5 to 2.5% Mn, 0.2 to 1.0% Ni, 0.5 to 1.5% Al, 0.1 to 1.0% Fe, optionally also up to a maximum of 0.1% Pb, optionally also up to a maximum of 0.2% Sn, optionally also up to a maximum of 0.1% P, optionally also up to a maximum of 0.08% S, the rest being Cu and inevitable impurities, with mixed silicides containing iron, nickel and manganese embedded in the matrix.

5 Claims, No Drawings

REFILL FOR A BALL-POINT PEN AND USE THEREOF

The invention relates to a refill for a ballpoint pen and to the use thereof.

Document DE 10 2009 021 336 A1 discloses copper-nickel-zinc alloys for writing implements. Higher-quality refill tips for ballpoint pens are often produced from nickel silver for esthetic reasons. These are manufactured from machinable nickel silver wire material as kneading materials of the following composition: Cu: 40.0% to 48.0% by weight, Ni: 8.0% to 14.0% by weight, Mn: 4.0% to 6.5% by weight, Si: 0.05% to 1.5% by weight, balance: Zn and unavoidable impurities. There may optionally be up to 1.5% by weight of Al or up to 2.5% by weight of Pb in addition. This nickel silver alloy consists of a biphasic structure consisting of α and β phases with silicides intercalated therein.

In addition, document EP 1 608 789 B1 discloses a copper-based alloy suitable for use in the production of ballpoint pen components. The alloy has the following composition: Cu: 43% to 48% by weight, Zn: 33% to 38% by weight, Ni: 10% to 15% by weight, Mn: 3.5% to 6.5% by weight, the alloy having a monophasic a structure and a biphasic α/β structure. An important feature of this alloy is that at least one process step of heat deformation of the alloy results in conversion of the initially present biphasic α/β structure, in conjunction with a thermal treatment, to a monophasic a structure. The aim is consequently to form a ballpoint pen component having a single crystalline phase of uniform structure.

It is an object of the invention to further develop a ballpoint pen refill.

The invention with regard to the ballpoint pen refill is described by the below features and also with regard to the use of the ballpoint pen refill and further advantageous forms and developments of the invention.

The invention includes the technical teaching of a refill for a ballpoint pen, consisting of an ink vessel and a ballpoint, the ballpoint being disposed in a writing tip at the foremost end of the ink vessel, wherein at least the writing tip of the ink vessel consists of a copper-zinc alloy of the following composition (in % by weight):

28.0% to 36.0% Zn,
0.5% to 1.5% Si,
1.5% to 2.5% Mn,
0.2% to 1.0% Ni,
0.5% to 1.5% Al,
0.1% to 1.0% Fe,
optionally up to a maximum of 0.2% Pb,
optionally up to a maximum of 0.2% Sn,
optionally up to a maximum of 0.1% P,
optionally up to 0.08% S,
balance: Cu and unavoidable impurities, with mixed iron-nickel-manganese-containing silicides intercalated in the matrix.

The writing tip may be connected as an independent part to the rest of the ink vessel. Alternatively, the ink vessel may also be in a one-piece design together with the writing tip.

It has been found that, surprisingly, writing implements, especially ballpoint pens, having a writing tip provided at the foremost end of a writing body can also be formed with other alloys than nickel silver alloys, for example. To date, the use of such alloys was envisaged according to the applicant's own German published specification DE 10 2007 029 991 A1 only for use for sliding elements in internal combustion engines, transmissions or hydraulic assemblies.

The content of this published specification is incorporated in full into the present description. Such different uses are pursuing a different purpose of a combination of properties optimized to specific end uses: a combination of properties in the form of an increase in strength, thermal stability of the structure and complex wear resistance combined with simultaneously adequate ductility properties, especially in engine applications. In addition, the alloy has good emergency running properties in slide bearing applications, which counteract the wear of the bearing partners.

The invention proceeds from the idea of using a copper-zinc alloy with intercalated mixed iron-nickel-manganese-containing silicides which can be produced with the aid of the continuous or semicontinuous strand casting method. As a result of the mixed silicide formation, the copper-zinc alloy has a high hard phase content, which contributes to an improvement in the material resistance to abrasive wear in conjunction with the ballpoint ball as a friction partner.

Thus, the alloy has high hardness and strength values and, nevertheless, assures a necessary degree of ductility, as expressed by the elongation at break value in a tensile test. With this combination of properties, the subject matter of the invention is particularly suitable for use in a ballpoint pen refill.

In the course of the casting of the alloy, there is at first early precipitation of iron- and nickel-rich mixed silicides. These precipitates, in the course of further growth, can grow to become mixed iron-nickel-manganese-containing silicides of considerable size, often in columnar form. In addition, a considerable proportion also remains comparatively small with a globular shape, finely distributed in the matrix.

The finely distributed silicides in particular are considered to be a reason why stabilization of the β phase takes place. This makes an important contribution to an increase in thermal stability and wear resistance.

For production of ballpoint pen refills, holes are drilled centrally through the length of wire sections of about 15 to 20 mm in length. A staged contour is introduced into the tip, such that a ball, for example, of tungsten carbide can be pressed in. Final crimping fixes the ball in such a way that it can rotate without any play, but does not come out of the refill tip. For this purpose, the alloy has to have sufficient cold-forming capacity to enable crack-free crimping of the tip around the ball. The ink consumption of a ballpoint pen is determined by the wear of the ball seat by the tungsten carbide ball. The material should also accordingly be corrosion-resistant with respect to ink. Both the necessary cold forming capacity and the corrosion resistance are assured by the alloy of the invention.

The particular advantage of the alloy of the invention is based on a combination of properties optimized for the end uses in the form of an increase in strength, in the thermal stability of the structure and in the wear resistance with simultaneously sufficient toughness properties. In addition, the alloy has a good corrosion resistance with respect to the inks used customarily. In addition, the material solution claimed, on account of the absent or extremely low lead content, takes account of the necessity for an environmentally friendly alloy.

Moreover, this material is designed for particular applications in which a necessary degree of plasticizability is important in spite of the high demands on hardness and strength. By virtue of the chosen element ranges of silicon and nickel, it is possible to gear the mixed iron-nickel-manganese silicide formation particularly to an optimized combination of properties, especially in relation to the necessary degree of ductility.

In the cast state, the structure may be present with a content of the β phase of up to 50% by volume. This is regarded as a necessary prerequisite for sufficiently good hot formability of the copper alloy by extrusion.

In a preferred configuration of the invention, after a further processing operation including at least one hot- or cold-forming operation and further annealing steps, the structure may be present with a content of the β phase of 5% up to 45% by volume, of the mixed Fe—Ni—Mn-containing silicides up to 20% by volume and a balance of α phase.

With these β intercalations and hard phases of different size distribution in an a matrix, this alloy assures an advantageous thermal stability of the structure with adequate toughness properties, and a proportionate wear resistance of the components. Particularly, the high silicide content, because of the low cold-welding tendency of the silicides, contributes to an improvement in the sliding and emergency running properties in the case of bearing elements, which can compensate for the absence of the Pb content. In this way, the requirement for better environmental compatibility of the materials used for writing implements has likewise been taken into account.

In a preferred embodiment, the mixed iron-nickel-manganese-containing silicides may be present in columnar form in the structure, as may mixed iron-nickel-enriched silicides in a globular shape. There are consequently two forms of the silicides, namely columnar and globular. In the course of the casting of the alloy, there is at first an early precipitation of iron- and nickel-rich mixed silicides. These precipitates, in the course of further growth, can grow to become mixed iron-nickel-manganese-containing silicides of considerable size in columnar form. In addition, a considerable proportion can also remain comparatively small with a globular shape, finely distributed in the matrix. Particularly, the finely distributed silicides are considered to be a reason why stabilization of the β phase takes place. This makes an important contribution particularly to an increase in wear resistance.

Advantageously, the ratio of the values of yield point and tensile strength of the alloy $R_{p0.2}/R_m$ may be between 0.5 and 0.95. This is an important prerequisite for the production of friction pairs of bearing points in the writing tip in the ink vessel in conjunction with hard metal balls. This further development of the copper-zinc alloy assures an excellent resistance to mechanical wear.

A process for producing rods from the copper-zinc alloy of the invention for refills comprises the following steps for further processing of the alloy:

extrusion within a temperature range from 600 to 800° C., at least one cold forming operation.

These rods can serve as starting material for the manufacture by machining of ink vessels or refill tips.

A further alternative aspect relates to a process for producing rods from the copper-zinc alloy of the invention for ballpoint pen refills, wherein further processing of the alloy comprises the following steps:

extrusion within a temperature range from 600 to 800° C., a combination of at least one cold-forming operation with at least one annealing operation within a temperature range from 250 to 700° C.

By means of a combination of cold-forming by drawing and one or more intermediate annealing operations on the rods within the temperature range from 250 to 700° C., it is possible to establish a fine distribution of the heterogeneous structure.

With this particular configuration of the copper-zinc alloy, a significant increase in tensile strength $R_m$, yield point $R_{p0.2}$ and the hardness of the material is achieved. The elongation at break of the alloy is likewise at a sufficiently high level, which means that the necessary toughness properties are established. Moreover, the exceptionally high content of hard phases, especially of the mixed iron-nickel-manganese-containing silicides, and the heterogeneous matrix structure composed of α phase and β phase assure target-oriented wear resistance of the components made from this material.

The relationship between the level and distribution of the proportion of the β phase and the thermal stability of the structure is already known. Since, however, this cubic body-centered crystal type assumes an indispensable strength-enhancing function in the copper-zinc alloys, the minimization of the β content should not be the exclusive priority. By means of the manufacturing sequence of extrusion/drawing/intermediate annealing operations, the phase distribution of the structure of the copper-zinc alloy can be modified in such a way that it additionally has sufficient thermal stability as well as a high strength.

The forming may be followed by at least one stress-relief annealing operation within a temperature range from 250 to 450° C.

In the course of manufacturing, it is necessary to reduce the level of internal stress by one or more stress-relief annealing operations. The lowering of internal stress is also important for the assurance of sufficient thermal stability of the structure and for the guarantee of sufficient straightness of the rods as starting material.

Further working examples of the alloy are elucidated in detail by a table. Cast ingots of the copper-zinc alloy of the invention were produced by die casting. The chemical composition of the castings is apparent from tab. 1.

TABLE 1

Chemical composition of the cast ingots (version A)

| No. | Cu [%] | Zn [%] | Si [%] | Mn [%] | Ni [%] | Sn [%] | Al [%] | Fe [%] |
|---|---|---|---|---|---|---|---|---|
| Alloy type 1 | 64.1 | 31.2 | 1.20 | 1.76 | 0.40 | <0.01 | 0.92 | 0.30 |
| Alloy type 2 | 63.6 | 31.7 | 1.17 | 1.75 | 0.55 | <0.01 | 0.87 | 0.33 |

Manufacturing sequence for alloy types 1 and 2:

Extrusion at the temperature of 700° C.

Combination of cold-forming/intermediate annealing (650° C./50-60 min)/straightening/stress-relief annealing (300-350° C./3 h).

After the manufacturing procedure, the mechanical properties are at the level shown by numerical values in tab. 2.

TABLE 2

Mechanical properties of the alloys (alloy type 1 and alloy type 2)

| No. | β content [%] | Particle size [μm] | $R_m$ [MPa] | $R_{p0.2}$ [MPa] | $R_{p0.2}/R_m$ | A5 [%] | HB |
|---|---|---|---|---|---|---|---|
| Alloy type 1 | 5 | 5-10 | 715 | 656 | 0.92 | 12.0 | 222 |
| Alloy type 2 | 5-10 | 10-15 | 660 | 577 | 0.87 | 13.2 | 207 |

Manufacturing Sequence:

Hot-rolling at the temperature of 750° C. on the laboratory scale

Combination of cold-forming/stress-relief annealing (300-400° C./2-3 h)

The invention claimed is:

1. A refill for a ballpoint pen, consisting of an ink vessel and a ballpoint, the ballpoint being disposed in a writing tip at the foremost end of the ink vessel, characterized in that at least the writing tip of the ink vessel consists of a copper-zinc alloy of the following composition, in % by weight:

28.0% to 36.0% Zn,
0.5% to 1.5% Si,
1.5% to 2.5% Mn,
0.2% to 1.0% Ni,
0.5% to 1.5% Al,
0.1% to 1.0% Fe,
optionally up to a maximum of 0.2% Pb,
optionally up to a maximum of 0.2% Sn,
optionally up to a maximum of 0.1% P,
optionally up to 0.08% S, with the balance being Cu and unavoidable impurities, and mixed iron-nickel-manganese-containing silicides are intercalated in the alloy matrix.

2. The refill for a ballpoint pen as claimed in claim 1, characterized in that the copper-zinc alloy after a further processing operation including at least one hot-forming or cold-forming operation and further annealing steps includes the structure having a content of the β phase of 5% to 45% by volume, a content of the mixed Fe—Ni—Mn-containing silicides of up to 20% by volume and a balance of α phase.

3. The refill for a ballpoint pen as claimed in claim 1, characterized in that the mixed iron-nickel-manganese-containing silicides are present in columnar form in the structure, as are mixed iron-nickel-enriched silicides in a globular shape.

4. The refill for a ballpoint pen as claimed in claim 1, characterized in that the ratio of the values of yield point and tensile strength $R_{p0.2}/R_m$ in the copper-zinc alloy is between 0.5 and 0.95.

5. A writing implement containing the refill of claim 1.

* * * * *